United States Patent [19]

Morsbach

[11] 3,941,060

[45] Mar. 2, 1976

[54] MONORAIL SYSTEM

[76] Inventor: Paul Morsbach,
Martinsholzerstrasse 13a, D-8131
Aufkirchen, Germany

[22] Filed: Feb. 8, 1974

[21] Appl. No.: 440,812

[30] Foreign Application Priority Data

| | | |
|---|---|---|
| Feb. 9, 1973 | Germany | 2306385 |
| June 8, 1973 | Germany | 2329423 |

[52] U.S. Cl. ..... 104/247; 104/63; 105/148; 267/9 C

[51] Int. Cl.[2] ..... B61B 3/00; B61B 12/02

[58] Field of Search ..... 104/89, 91, 63, 94, 110, 104/243, 245, 247; 105/148, 149, 150, 153, 154, 155, 156; 267/9 C

[56] References Cited

UNITED STATES PATENTS

| | | | |
|---|---|---|---|
| 634,807 | 10/1899 | Dinkelberg | 104/247 |
| 850,136 | 4/1907 | Cole | 104/63 |
| 1,501,060 | 7/1924 | Miller | 104/247 |
| 2,018,087 | 10/1935 | Plass | 105/153 |
| 2,020,540 | 11/1935 | Dunlap | 105/156 |
| 2,274,016 | 2/1942 | Verplanck | 105/148 |
| 2,966,321 | 12/1960 | Blattner | 267/9 C |
| 3,106,171 | 10/1963 | Julien | 105/149 |
| 3,170,412 | 2/1965 | Sowder | 105/149 |
| 3,795,201 | 3/1974 | Tack | 267/9 C |

*Primary Examiner*—James B. Marbert
*Assistant Examiner*—Robert Saifer
*Attorney, Agent, or Firm*—Stewart and Kolasch, Ltd.

[57] ABSTRACT

A monorail system for roller coasters comprising suspended track-bound vehicles each of which comprises a pair of distanced roller gears for movement along the track and support arms with a passenger car attached thereon arranged so as to prevent pivoting of the roller gears on the track means but permitting limited or controlled lateral swinging of the car relative to the roller gears.

6 Claims, 7 Drawing Figures

MONORAIL SYSTEM

BACKGROUND OF THE INVENTION

This invention relates to conveying systems and more specifically to monorail systems or overhead operation, i.e. with suspended cars, cabins, or the like load receiving arrangements. The invention is particulary related to roller coaster type arrangements, i.e. where a car is caused to move along a rail-bound path arranged as a closed loop with more or less inclined portions and a series of curves, i.e. for amusement purposes in fairs, amusement parks and the like.

Monorail systems with suspended vehicles for moving persons or goods are known in the art. Normally, such systems are constructed so as to avoid steep passages, i.e. they lack substantial inclinations against the horizontal. To prevent lateral pivoting or swinging of the vehicles or cars one tends to avoid curves, notably narrow curves and lateral guide rails must be provided at the stops or loading stations so as to retain the cars from lateral movements, i.e. swinging.

For amusement purposes, such as in fairs or amusement parks, monorail systems with suspended cars or cabins have been suggested. Such systems have a rail type element arranged in a closed loop and in the manner of roller coasters, i.e. comprising portions with a steep inclination and/or with narrow curves.

German Pat. No. 80,980 teaches cabins having rollers rigidly mounted at the roof of the cabins. The rollers are suspended on a rail helically arranged around a tower so that the cabins will move downwardly around the tower. Accordingly, the cabins are free to swing in any plane, i.e. in planes substantially parallel to the rail, in planes substantially vertical to the rail and in any plane intermediate between the vertical and the parallel planes.

Another prior art rail-bound system of the type in question is disclosed in German Pat. No. 367,410 and comprises a rail having an inverted T-shaped cross-section. A roller gear is rigidly connected to each car and comprises two adjacent support rollers. One roller each is support by one side of the laterally extending component of the rail, i.e. one of the lateral arms of the inverted T-profile of the rail. This arrangement is intended to prevent lateral swinging movement or pivoting of the car while permitting longitudinal swinging, i.e. pivoting in the plane which is parallel to the direction of travel.

French Pat. No. 1,167,272 discloses a further conveying system for amusement purposes and includes cars in rigid connection with a roller gear. The roller gear comprises at least one support roller and lateral guide rollers to provide for a substantially rigid guidance of the moving car or vehicle, i.e. to prevent any swinging or pivoting at all.

When a body is moved through a curve, the centrifugal force will increase as the curve radius decreases and as the speed increases. In monorail systems with suspended cars or cabins the centrifugal forces will cause a freely suspended (i.e. not prevented to swing in any plane) vehicle or car to swing or pivot from its "normal position," i.e. where it is in a position substantially perpendicular below the rail, into an inclined or tilted position. Since the rails or a roller coaster type arrangement for amusement purposes will generally include intermediate straight path portions as well as curved path portions, the full centrifugal forces will act upon the vehicle or car as soon as it enters a curve. As a consequence, a car in such a curve will not only swing into a position corresponding to the resultant of gravitational and centrifugal forces but will first tend to overswing, i.e. swing beyond the position of said resultant, and swing back thereafter. Such pendulum type movement may be quite dangerous because it is slow if compared with the normal travel speed of the car and since, accordingly, it is guite possible that the car after overswinging in a first curve will continue to swing beyond its normal position when entering the next curve. This may cause rather extreme stresses in the car and its suspension and would require extremely strong and very expensive rail structures to prevent structural breakage and still endanger the passenger or passengers.

The lack of acceptance of monorail systems with suspended cars for roller coaster type installations for amusement parks, fairs or the like is probably due to these disadvantages. In theory, overswinging of the car due to centrifugal forces can be avoided if circular curves are replaced by so-called clothoidal curves (Cornu-curves). In practice, however, it is not feasible because it would require a very complicated rail or track structure. Also, it would require much more space than normally available for roller coaster installations.

SUMMARY OF THE INVENTION

Accordingly, it is an object of the invention to provide for a monorail system with suspended load receiving devices such as cars which will not overswing when moved through a series of normal curves.

It is another object of the invention to provide for a roller coaster type monorail system with suspended cars, which systems does not require more space than well known roller coaster arrangements where cars run on rails.

Still another object of the invention is a roller coaster type monorail system with suspended cars where the passengers are not endangered by the effects of centrifugal forces encountered when such cars move along a series of curved path portions.

Yet another object of the invention is a roller coaster type monorail system with suspended cars which provides for increased safety and increased travelling pleasure without substantial increase of costs and the amount of structural material required for such an installation.

Further objects will become apparent as the specification proceeds.

I have found that the above and other objects can be achieved with a monorail system comprising track means and one or more vehicles suspended on said track means; each vehicle comprising a pair of roller gears in a sequential arrangement on said track means, car means, and at least one support arm connected with said car means; said roller gears and said track means being operably connected to permit movement of said roller gears along said track means and to substantially prevent pivoting of said roller gears on said track means; said roller gears being movably connected with said support arm of said vehicle to permit lateral swinging of said car means and said support arm relative to said roller gears; and means for limiting said lateral swinging of said car means and said support arm.

Expressed in other words, I generally achieve the above objects by pivotably connecting a pair of roller gears designed to move on a track in an essentially rigid, i.e. non-pivotable manner with the support arm or arms of the corresponding vehicle and by limiting and/or controlling lateral swinging of the support arm or arms and the car or cabin pendingly attached thereon.

The phrase "roller coaster type installation" is intended to refer to any rail-bound conveyance system for amusement purposes and comprising a path including both steep ascents and descents as well as a series of curves. Normally, the start will be rather near the end, e.g. to form a closed loop rail arrangement, and some sort of holding area for cars not in operation will be provided for, if required with switch points to introduce or remove cars from the system. Drive means can be provided, either on the cars with suitable power supply along the path or portions thereof but will generally be arranged near the rails to pick up the cars and move them to an elevation from which they descend or coast along the rail under the impact of gravitation. Brake means can be provided at portions of the rail (external) or/and within the cars. All such parts and means as well as their operation are well known in the art.

Also, as it is conventional for both roller coasters and prior art monorail systems, such installation will include supports for the rail or track such as to keep them in a predetermined pattern or path. Girder structures and the like supports with or without interconnecting means for permanent or temporary operation are well known in the art and will not be discussed hereinafter.

The roller gears and the cooperating elements will be explained more in detail below. It should be noted that while I use a pair of such gears in a sequential arrangement, this terminology is intended to encompass any arrangement where one such gear follows or precedes the other on the track. Trailing or coupling of the gears other than via the car and its arm or arms is possible but not required. The distance between the two roller gears of any vehicle will normally depend upon the length of the appended car and/or the expected load and should, in general, be sufficient to substantially prevent swinging of the car in a longitudinal direction, i.e. in a plane parallel to the rail. While at least one support arm of the vehicle will be connected with the pair of roller gears, it is possible and generally preferred to use two such support arms per vehicle and connect each arm with one roller gear of the pair. When using a single support arm, such structure would require a branched portion such as a Y-shaped arm, the lower end of which is secured on the car while one of its upper ends each is pivotably connected with one roller gear each.

Such pivotable connection can be achieved by means of a ball-and-socket joint. The ball of such joint may be part of the upper end of the support arm while the socket is provided within or on the roller gear, e.g. on a gear frame. Stop faces are provided in this embodiment as means for limiting lateral swinging. Such stop faces can be provided in or on the roller gears or on the socket of the joint.

Another preferred feature of the inventive monorail system is a damping installation for limiting or/and controlling laterally swinging or pivoting movements of the support arms and the car attached thereon. These and other means for limiting a pivoting along a given plane can be used simply or in combination.

BRIEF DESCRIPTION OF THE DRAWINGS

The invention will be better understood and objects other than those set forth above will become apparent when consideration is given to the following detailed description thereof. Such description makes reference to the annexed drawings showing preferred embodiments of the inventive system and its components in a simplified or semi-diagrammatic manner.

In the drawings.

DETAILED DESCRIPTION OF THE DRAWINGS

Figure 1:
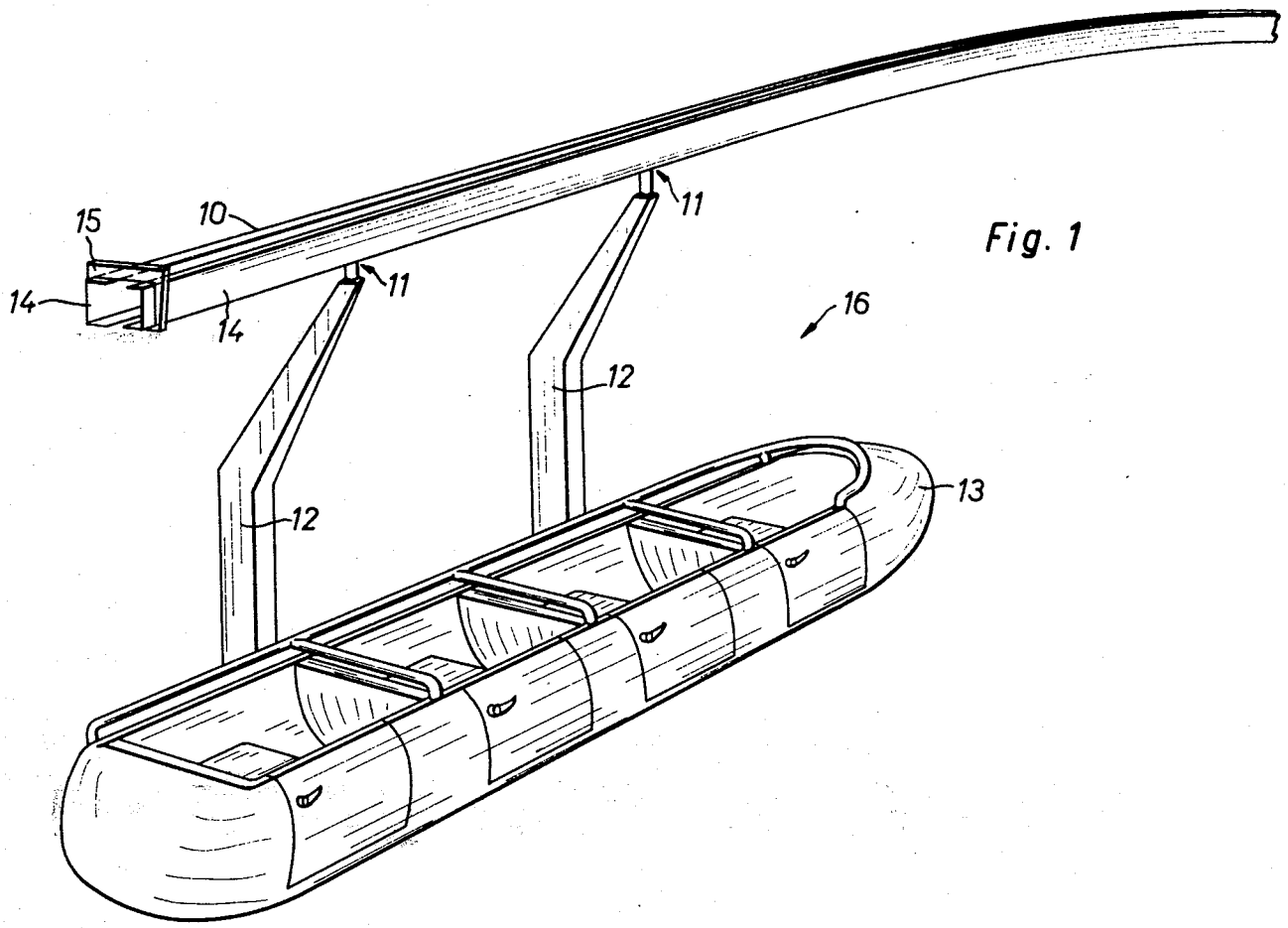
FIG. 1 is a fragmentary view of one embodiment of the track means for the monorail system according to the invention with a car suspended on the track means.
Figure 2:
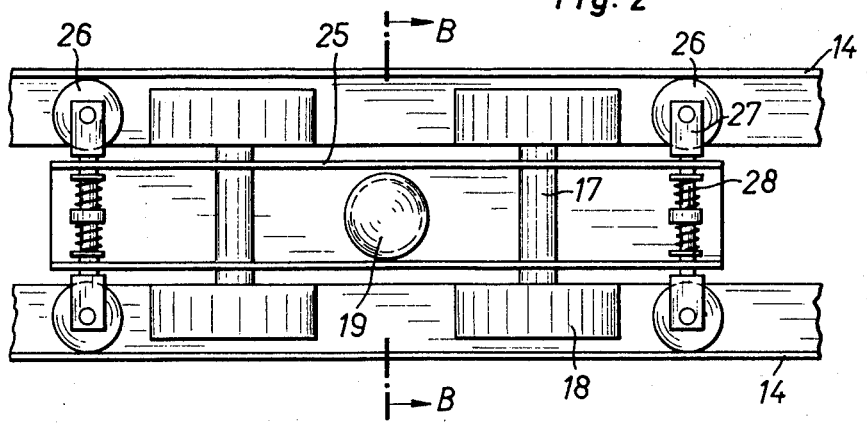
FIG. 2 is a vertical cross-section of a portion of the track means shown in FIG. 1 with a preferred embodiment of a roller gear in a partially sectioned view.
Figure 3:
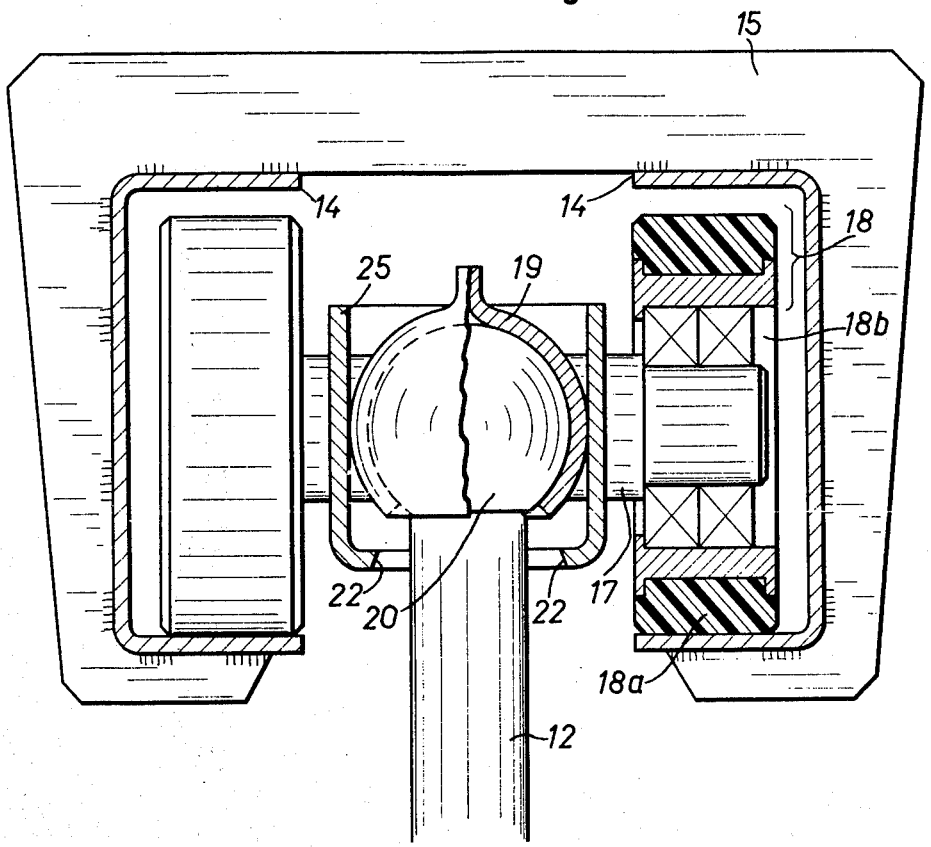
FIG. 3 is a cross-sectional view along B—B of FIG. 2 through the track means and the roller gear.

With reference to FIG. 1, a portion of track means 10 as well as a vehicle 16 are presented to show an example of the novel suspension according to the invention. Vehicle 16 comprises two roller gears 11 (the structure of which is not apparent from FIG. 1 but is shown in FIG. 2 and 3 as explained below) and is encompassed by track means or rail structure 10. Vehicle 16 further includes a pair of support arms 12 and a car 13. The track or rail structure 10 includes two U-shaped profiles 14 arranged at a distance with their open ends turned towards each other. For securing and connecting the pair of U-shaped profiles 14 to form track or rail structure 10, a plurality of clamps 15 is provided along the structure but only one such clamp 15 is shown in FIG. 1 for simplicity. Clamps 15 can also serve for connecting the track structure with supports (not shown) for keeping the track at the desired elevation above the ground. As stated above, suitable supporting structures are well known to the expert and do not require detailed explanation. Both support arms 12 are rigidly connected with car 13, the details of such connection being a matter of choice in view of the structural materials involved and the operating requirements but do not require detailed explanation. In general, however, car 13 should be secured in a manner such that the maximum load of car 13 plus its own weight is securely supported by the support arms 12 under the conditions of operation. The pivotable connection of arms 12 with roller gears 11 will be explained in detail in connection with the following Figures.

The car body may be of any conventional structure and may include, for example, four pairs of seats arranged in four compartments each provided with a door at the side of the car opposite arms 12. Again, the details of the car are not critical and, while an open car or gondola is shown in FIG. 1, any other suitable type of car with one or more compartments and if desired with a preferably transparent roof or the like can be used depending upon the specific requirements, notably the location and climate of the site where the roller coaster is to be operated. Whenever track or rail 10 is to form a curved path, the U-shaped profiles 14 can be arranged in inclined positions such that their sides are in a substantially parallel arrangement in accordance with the direction of the expected forces at that particular portion of the track.

The structure of an embodiment of the roller gear is shown in FIG. 2 and 3. Two shafts 17 are provided in a roller gear frame 25, each shaft carrying two rollers 18. Each roller 18 is provided with a tread 18*a*, e.g. of natural or synthetic materials known for tread purposes, e.g. polyurethane. Roller bearings 18*b* are provided between rollers 18 and shafts 17. Viewed in the direction of movement, a ball socket 19 is provided between the two shafts 17 to movably support a ball 20 in the manner of a ball-and-socket joint. Ball 20 is secured to the upper end of support arm 12. The ball-and-socket joint provides for swinging motion of car 13 in a lateral direction, i.e. in a plane substantially vertical to the direction of forward movement. Both shafts 17 are arranged in frame 25 which serves to transmit the entire load from the ball-and-socket joint 19, 20 to the four rollers 18. Stop faces 22 are provided at the lower end of frame 25 to serve as the means for limiting pivoting or swinging movement of the upper end of support arm 12 so that such movement cannot exceed a predetermined value. The actual leaner of the vehicle at a given point of its path may, however, exceed the angle of movement limited by the stop faces when the rails, as mentioned previously, are, in a curve, arranged in an inclined position. The swinging or pivoting movement provided by ball 20 will then correspond to the deviation from the average inclination defined by the inclined arrangement of the rail.

The roller gear further includes two pairs of lateral guide or stabilizing rollers 26 serving to improve lateral guidance of the roller gears within the pair of U-shaped profiles which form the track or rail. Preferably, such lateral guide rollers 26 are supported by forks 27 and are capable of lateral movement (in relation to the transport direction). Normally, guide rollers 26 will be pressed towards the sides of the U-shaped profiles, e.g. by springs 28. Such guide rollers 26 are particularly suited to receive lateral forces when the car swings over its central position, while rollers 18 merely serve to receive forces acting in a direction vertical to their tread face.

Figure 4:
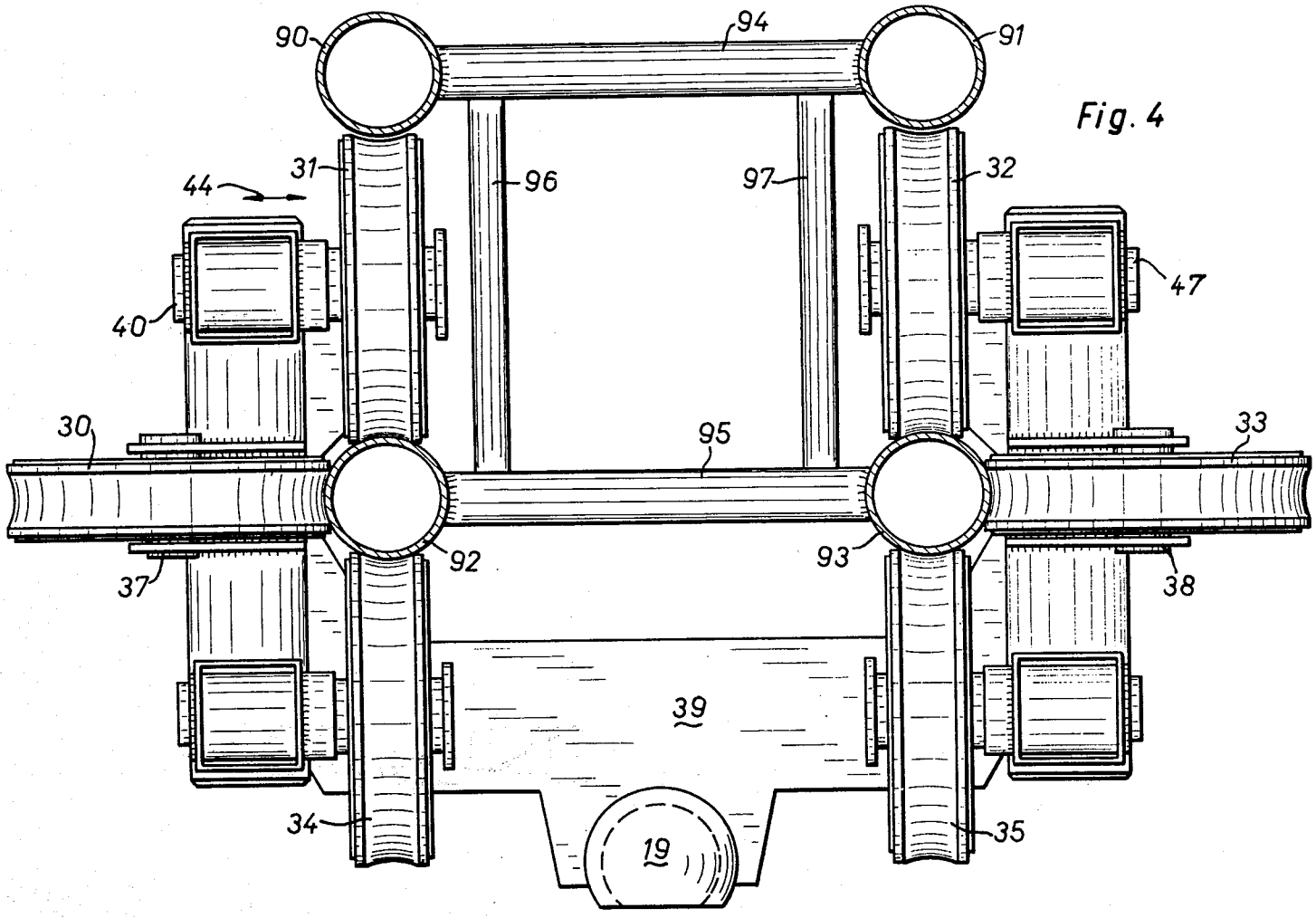
FIG. 4 is a cross-sectional view of another embodiment of the track means and roller gear cooperating therewith.

Another embodiment of track means and cooperating roller gears is shown in FIG. 4 in a cross-sectional view. Here, the track or rail means include four tubes 90, 91, 92 and 93 or similar elongated structures such as bars, rods or other rail profiles arranged in a rectangular pattern, i.e. at the corners of a rectangle, the longer side of which is arranged in a horizontal direction. This arrangement provides for specific advantages because the bigger momentum of resistance of the total cross-section of the rail structure is in horizontal direction. This corresponds with the stronger forces acting in such direction. In the operation of a monorail system including suspended cars, e.g. in a roller coaster type arrangement in accordance with the invention, centrifugal forces may be generated in the order of multiples of the gravitational force, i.e. in the order of several g's.

As shown in FIG. 4, the four tubes forming the track or rail structure are interconnected by connecting struts 94, 95, 96 and 97, the vertical struts 96 and 97 being offset towards the center of the framework such that space is provided between tubes 90, 92 and 91, 93, respectively, for passage of the rollers. Generally, further struts (not shown) will be provided for diagonal connections.

Figure 5:
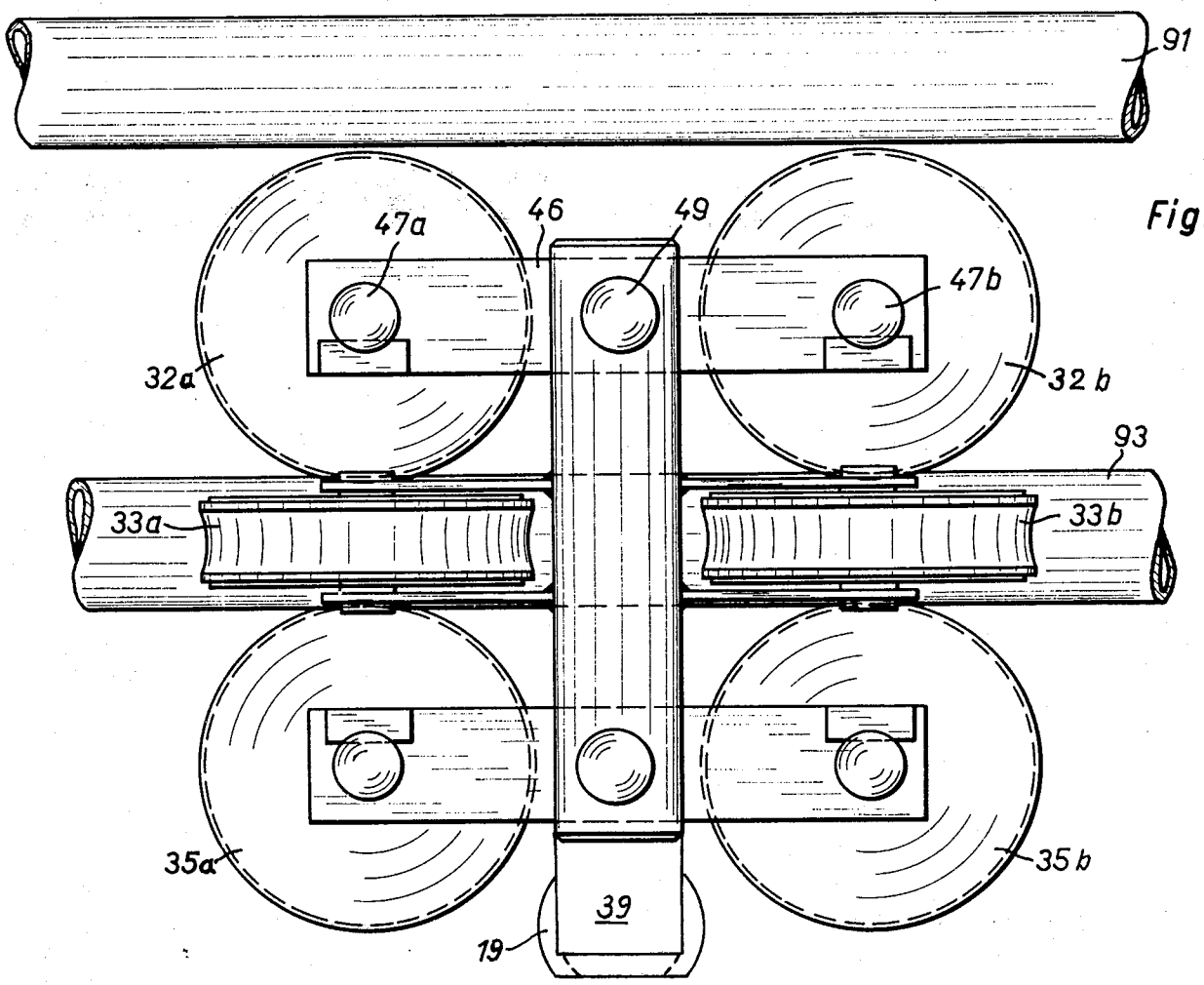
FIG. 5 is a side elevational view of the roller gear shown in FIG. 4.

Preferably, each roller gear of the type shown in FIG. 4 and 5 includes twelve rollers. Support roller pairs 31 and 32 (only one roller of each pair being apparent in FIG. 4) are guided on tubes 92 and 93 and receive and support all vertically acting forces from frame 39. Two pairs of rollers 34, 35 are arranged below tubes 92, 93 to prevent lifting off of support rollers 31, 32 and their contact with upper tubes 90, 91 whenever forces appear which act in an upward direction. Such contact would lead to an undesirable braking action.

The cross-sectional pattern of the track-forming tubes should remain substantially constant at any part of the track or rail structure, i.e. connecting struts 94, 95 should always be in a substantially horizontal alignment. Because of the pivotably joined connection of the roller gears and the car, no inclination of the rail structure is required in curved portions of the path. This provides for a substantial simplification of the track or rail structure.

Two roller pairs 30, 33 are provided to laterally engage tubes 92 and 93. These rollers serve to receive only such forces which act in a horizontal direction, i.e. centrifugal forces. Accordingly, only one of the pair of rollers 30, 33 is capable of contactingly engaging the adjacent tube of the rail structure. Roller pairs 31, 32 on the other hand may simultaneously engage or rest upon the adjacent tube. All rollers are rotatably secured on frame 39 which in turn is connected with a joint structure or connection 19 for swingingly or pivotably holding the support arm of the car.

Shafts 37, 38 of rollers 30, 33 are rigidly connected with frame 39. Since only one of the pairs of roller 30, 33 will at any given moment be in contacting engagement, i.e. transmit forces, frame 39 will automatically be aligned or oriented such that either both rollers 30 or both rollers 33 will contribute to lateral guidance at a given moment. Shafts 40 of the two rollers 31 are also connected rigidly with gear frame 39. The pair of rollers 31, however, is slidingly mounted on shafts 40 and is capable of displacement as indicated by arrow 44. As a consequence, rollers 31 will always run centrically, i.e. at the top of tube 92 even if the distance between tubes 92 and 93 may somewhat change over the length of the rail structure in view of allowable or necessary tolerances in production. Both rollers 32*a*, 32*b* are rotatably secured by means of shafts 47*a*, 47*b* on swivel arm 46. Swivel arm 46 in turn is rotatably connected with frame 39 by means of shaft 49. It is apparent that both rollers 32 as well as both rollers 31 will uniformly support loads without regard to normal tolerances or deviations in the production or use of the rail structure.

Instead of ball socket 19 and the corresponding ball joint components (not shown), or in addition to such joint, universal couplings or gimbal bearings well known in the art are used in a preferred embodiment for the suspension of the support arm or arms on the roller gears. By the same token and for the same purposes, the support arm can be suspended by means of a ball-joint-socket which in turn is connected with the frame by means of a journal secured thereon.

Figure 6:
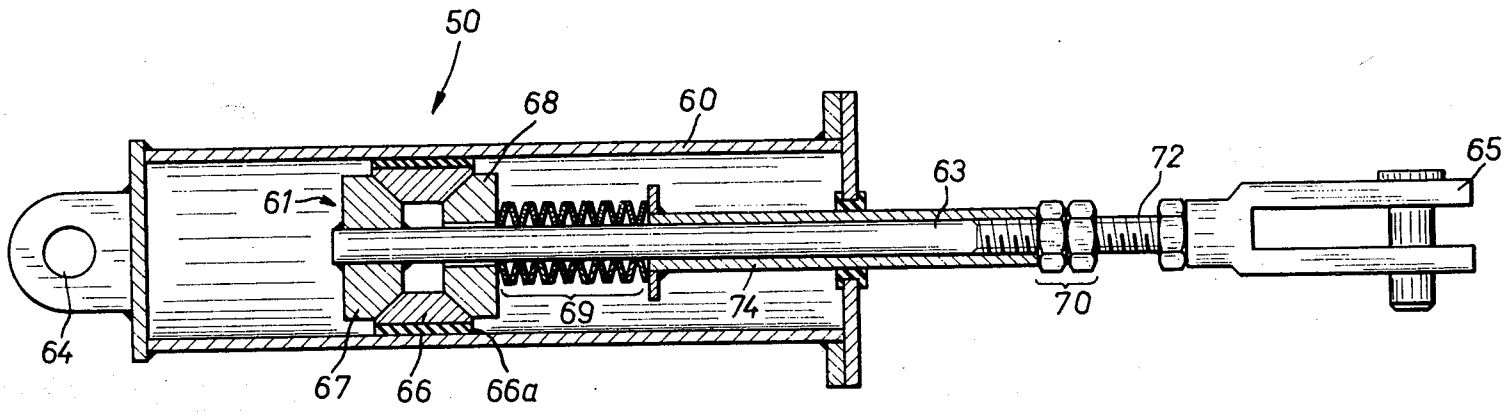
FIG. 6 is a sectional view of a preferred embodiment of a damper installation.
Figure 7:
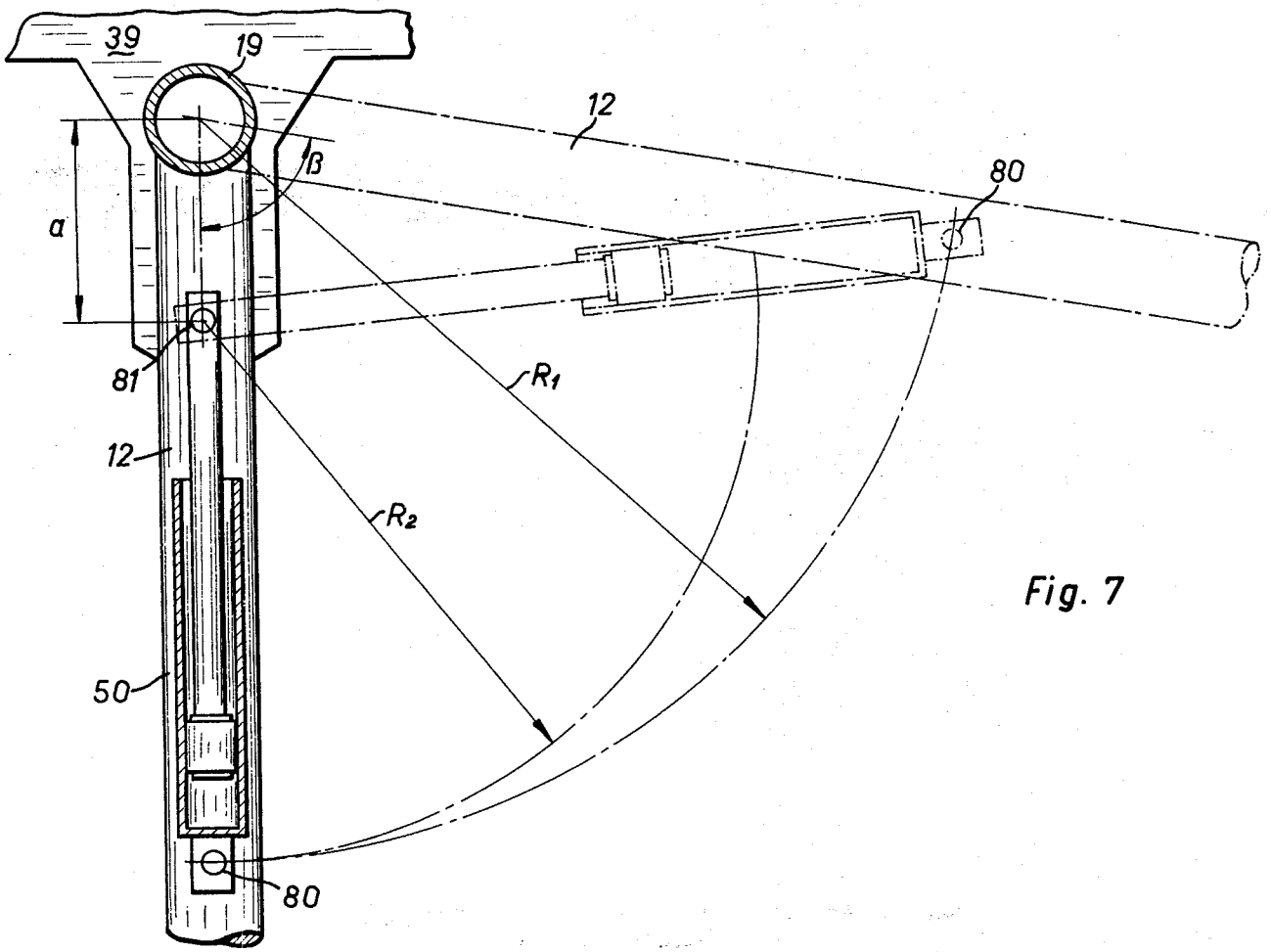
FIG. 7 is a diagrammatic fractional view showing the suspension of a car on the roller gear shown in FIG. 4 and the operation of the damper installation of FIG. 6.

A preferred embodiment of a damper element for controlling or limitingg lateral pivoting of the car is shown in FIG. 6. Such an element is most suitable to prevent overswing or pendulum-type movement of the car. Damper element 50 has the general outer shape of an hydraulic cylinder comprising a cylinder housing 60, piston 61, piston rod 63 and securing eyes 64 and 65. Piston 61 may, for example, comprise jaws 66 provided with friction liners 66*a* capable of being pressed onto the inner wall of the cylinder housing by means of two tapered structures or cones 67, 68. Cone 67 is directly connected with piston rod 63 while cone 68 is connected with the piston rod via a pack of cup springs 69 in tube 74, nuts 70 and a thread 72 on the piston rod. By means of nut 70 the force which presses such friction jaws onto the inner cylinder face can be adjusted in accordance with a predetermined value. With a suitable length of spring column 69, such force or friction contact will not change in continued use nor will it be affected by partial abrasion of friction liners 66*a*. Accordingly, nut 70 can be used to exactly pre-set the force required to longitudinally displace piston 61 within cylinder housing 60. Upon each movement of this type, kinetic energy will be transformed into heat. The damper element shown provides for transformation of kinetic energy into heat without a time lag. Accordingly, damper element 50 operates different from normal damper elements known in the art, such as shock absorbers.

One end of damper element 50 is connected with support arm 12, while its other end is pivotably connected with frame 39. Connecting point 81 of damper element 50 on frame 39 is situated below connecting point 19 of support arm 12. The distance between these two points is indicated as *a*. When the car swings in a lateral direction, securing point 80 of damper element 50 on support arm 12 will move along a circular path of radius $R_1$ around securing point 19 and along a circular path of radius $R_2$ around securing point 81 of damper element 50. Accordingly, the change of length of the damper element 50 between these two securing points is a function of angle $\beta$. The change of length of the distance between points 80 and 81 is negligibly small during small swings around the normal position. However, when the car swings by an angle $\beta$ of for example 80°, the change of length is quite substantial. In other words, a small angle of swing relative to the normal or vertical position will have almost no effect, while a large angle of swing will cause a pronounced effect of the damper element. Accordingly, the damping effect on a swing will increase as angle $\beta$ increases. When entering a curve, the car will swing out fast and without delay. As the swing progresses, the damping effect becomes stronger and a pendulum-type movement around the stable equilibrium position will be attenuated quickly. Upon exit from a curve, the friction or braking effect will become effective again in the reverse movement of the swing so as to kill kinetic energy, i.e. transform it into heat. Accordingly, the car will soon return to a minimal swinging motion around the vertical or normal position. However, this residual swinging is no disadvantage and may in an installation for amusement purposes contribute to causing the passenger's impression of floating or free flight movement.

With each damping action, force will be transmitted from the damper element 50 to point 81 and this force will act as a force of rotation on the roller gears. Rollers 34, 35 shown in FIG. 4 will receive this force and the pair of rollers 34 will be pressed onto tube 92 while the pair of rollers 35 will be pressed onto tube 93.

It is, of course, possible to combine several cars to a train. On the other hand, several distanced cars can be carried through the system individually as desired. For combining several cars such as to form a train, flexible connections between the cars are preferred. In this connection, it is preferred to provide rounded bumpers at each end of a car so as prevent that the cars are displaced due to non-uniform deceleration. The bumpers can be shaped and arranged such that a secure mutual contact between adjacent cars will be ascertained for a given shape or path of the systems, i.e. the track or rail structure.

The path of the track or rail structure can be adapted to conform with the requirements of a given transportation problem. For example, guidance and drive can be arranged in a manner well known in connection with prior art roller coasters, particularly those systems intended for repeated assembly and disassembly at various sites. Aside from the effects set forth above, novel amusement effects can be caused by a sinuidal or wave-like path of the track or rail because the cars will be caused to move through a series of lateral swinging motions. Such motions will be caused at each curve maximum of the path.

Various modifications of the invention will be apparent to the expert. The roller gears, for example, can be provided with internal drives and internal brakes. Alternatively, brakes can be arranged stationary outside of the vehicles. By the same token, stationary guide elements can be provided to externally act upon vehicles or parts thereof and to additionally prevent or limit certain deviations from the normal central or another predetermined or desired position.

While the invention has been explained mainly in connection with roller coaster type systems for amusemeent purposes, it is understood that the monorail system according to the invention can be used for any movement of suspended loads along a path. For example, the inventive system can be used as an overhead conveyer for commercial operation, notably for fast transportation of goods from one place to another in a strongly curved path.

What is claimed is:

1. A monorail system comprising track means and at least one vehicle suspended on said track means; said vehicle comprising roller gear means on said track means, said track means comprising a substantially rigid structure of four interconnected elongated elements selected from the group consisting of tubes, bars, rods and rails, said structures having a substantially rectangular cross-section with one of said elongated elements arranged at each corner of said rectangular cross-section, car means, and at least one support arm connected with said car means; said roller gear means and said track means being operably connected to permit movement of said roller gear means along said track means and to substantially prevent pivoting of said roller gear means about said track means in any direction with respect to said track means; said roller gear means including support roller means rotatably arranged on a first set of axes and guide roller means rotatably arranged on a second set of sxes, said first set of axes being substantially perpendicular to said second set of axes; said roller gear means being movably connected with said support arm of said vehicle to permit lateral swinging of said car means and said support arm relative to said roller gear means; and means for damping said lateral swinging or pivoting of said car means and said support arm.

2. The monorail system of claim 1, wherein said support roller means are slidably supported for lateral movement along said first set of axes and said guide roller means prevent slidable movement thereof beyond a predetermined distance.

3. A monorail system comprising track means and at least one vehicle suspended on said track means; said vehicle comprising roller gear means on said track means, car means, and at least one support arm connected with said car means; said roller gear means and said track means being operably connected to permit movement of said roller gear means along said track means and to substantially prevent pivoting of said roller gear means on said track means; said roller gear means being movably connected with said support arm of said vehicle to permit lateral swinging of said car means and said support arm relative to said roller gear means; and means for damping said lateral swinging or pivoting of said car means and said support arm, said means for damping comprising a pair of substantially coaxial elongated components for mutual displacement relative to each other in the direction of the common axis thereof, said axis being displaced from and substantially coplanar with said support arm in a plane perpendicular to direction of swing thereof when said support arm is disposed normal to the plane of said track means, said means for damping havig one end connected with said support arm and the other end thereof connected with said roller gear means, said mutual displacement of said elongated components having a continuous increase of the damping effect per angular unit with increasing angle of the car with respect to the free hanging normal position.

4. The monorail system of claim 3, wherein said means for damping includes means for adjusting the damping effect thereof.

5. A monorail system comprising track means and at least one vehicle suspended on said track means; said vehicle comprising roller gear means on said track means, said roller gear means engaging upper, lower, and side surfaces of said track means, car means, and at least one support arm connected with said car means; said roller gear means and said track means being operably connected to permit movement of said roller gear means along said track means and to substantially prevent pivoting of said roller gear means about said track means in any direction with respect to said track means; said roller gear means including support roller means rotatably arranged on a first set of axes and guide roller means rotatably arranged on a second set oof axes, said first set of axes being substantially perpendicular to said second set of axes; said roller gear means being movably connected with said support arm of said vehicle to permit lateral swinging of said car means and said support arm relative to said roller gear means; and means for damping said lateral swinging or pivoting of said car means and said support arm.

6. A monorail system comprising track means and at least one vehicle suspended on said track means; said vehicle comprising roller gear means on said track means and car means, said car means having at least one support arm; said roller gear means and said track means being operably connected to permit movement of said roller gear means along said track means and to substantially prevent pivoting of said roller gear means on said track means; said roller gear means being movably connected with said support arm of said car means to permit lateral swinging of said car means about an axis substantially parallel with respect to said track means; and means for damping said lateral swinging or pivoting of said car means; said means for damping comprising a pair of elongated components for mutual displacement relative to each other, said movement transforming kinetic energy into heat, said means for damping having one end connected with said car means and the other end thereof with said roller gear means at a predetermined distance from said axis of swinging, said two ends of said damping means being substantially coplanar with said support arm in a normal position of said car means with respect to said track means, the mutual displacement of said two components of said damping means per angular unit of swinging of said car means increasing with the increasing angular distance of said car means from said normal position.

* * * * *